US006049324A

United States Patent [19]

Palalau et al.

[11] Patent Number: 6,049,324

[45] Date of Patent: Apr. 11, 2000

[54] MEMORY CONFIGURATION FOR GRAY SHADE ELD USING ON/OFF DRIVERS

[75] Inventors: Silviu Palalau, Birmingham; Philip M LeMay, Ann Arbor, both of Mich.

[73] Assignee: Lear Automotive Dearborn, Inc., Southfield, Mich.

[21] Appl. No.: 08/961,364

[22] Filed: Oct. 30, 1997

[51] Int. Cl.[7] ..... G09G 5/10

[52] U.S. Cl. ..... 345/147; 345/77

[58] Field of Search ..... 345/147, 76, 77, 345/89, 98, 204, 186, 510, 199, 508, 511

[56] References Cited

U.S. PATENT DOCUMENTS 4,559,535 12/1985 Watkins et al. ..... 340/793

FOREIGN PATENT DOCUMENTS 0778556 of 1997 European Pat. Off. .
2740598 of 1997 France .
2164776 of 1986 United Kingdom .

*Primary Examiner*—Regina Liang
*Attorney, Agent, or Firm*—Niro, Scavone, Haller & Niro

[57] ABSTRACT

A display system includes a decoder receiving frames each including a brightness code for each pixel. The decoder generates a plurality of refresh commands for each pixel in the frame based upon the brightness codes and stores each of the refresh commands in a different memory buffer. A driver reads the memory buffers sequentially at a refresh rate and drives the display based upon the refresh commands in each memory buffer.

10 Claims, 1 Drawing Sheet

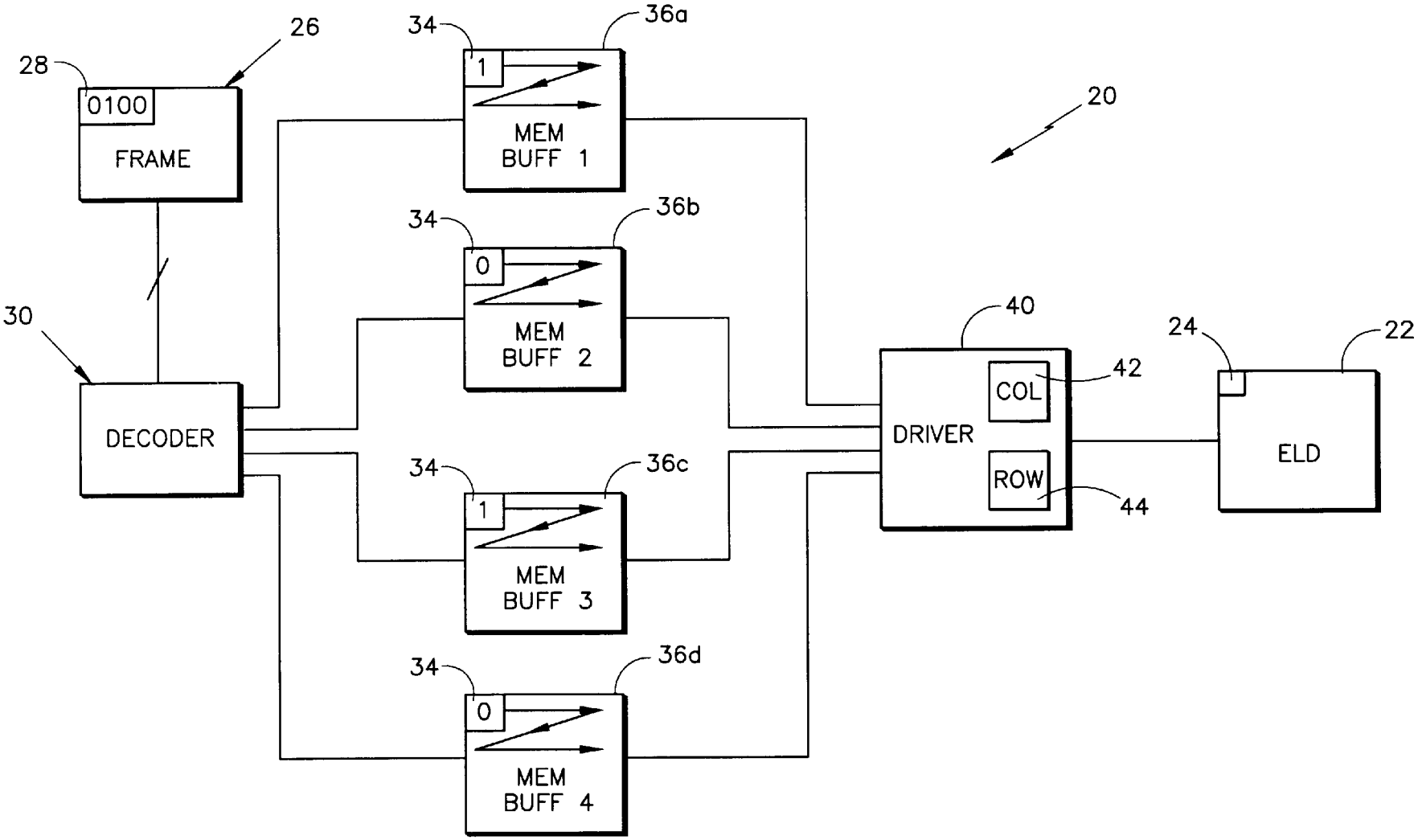
20
22
ELD
24
42
44
40
COL
ROW
DRIVER
36a
36b
36c
36d
MEM BUFF 1
MEM BUFF 2
MEM BUFF 3
MEM BUFF 4
1
0
1
0
34
34
34
34
26
FRAME
0100
28
DECODER
30

MEMORY CONFIGURATION FOR GRAY SHADE ELD USING ON/OFF DRIVERS

BACKGROUND OF THE INVENTION

The present invention relates generally to electroluminescent displays, and more particularly to a memory configuration for implementing gray shade electroluminescent displays.

As is known, electroluminescent displays or "ELDS" generally comprise a matrix of pixels, each of which is illuminated by a voltage potential between a row driver and column driver. The apparent brightness of a pixel can be varied by varying the refresh rate of that pixel. A pixel which is refreshed more frequently will appear brighter, while a pixel which is refreshed less frequently will appear dimmer. By varying the brightness of the different pixels in a display, a gray shade or gray scale image can be displayed.

Generally, a frame includes a brightness code for each pixel indicating a brightness level for that pixel in that frame. For example, the brightness code may comprise four bits of data indicating the brightness level for that pixel in that frame, with 0000 indicating that the pixel should be off, and 1111 indicating that the pixel should be illuminated at maximum brightness. In order to vary the brightness of a pixel utilizing a variable refresh rate, this brightness code must be converted to a refresh rate.

One way of utilizing a variable refresh rate among the pixels to implement brightness is to refresh the screen at a frequency which is multiple of the frame rate, refreshing each of the pixels a varying number of times for each frame. For example, for a frame rate of 60 htz, a refresh rate of 240 htz may be used. Thus, each pixel could be refreshed 0–4 times for a single frame, depending on the level of brightness indicated for that pixel. If a pixel is not refreshed during that frame, the pixel will be off. If the pixel is illuminated one time during the four refresh cycles, it will appear very dim. If the pixel is illuminated two or three times, it will appear brighter. If the pixel is illuminated four times in the four cycles, it will appear very bright.

One known configuration for implementing this technique is to decode the brightness information for each frame four times. During each refresh cycle for a frame, the decoder reads the brightness information for each pixel and stores a refresh command (a 0 or a 1) in a corresponding location for the pixel in a buffer. When all of the pixels have been decoded for a frame in a single refresh cycle, the buffer is copied to a second memory buffer, from which the column and row drivers are operated, illuminating or not illuminating each pixel as according to its associated refresh command. Over the four cycles, the decoder will send varying numbers of zeros and ones, depending upon the level of brightness indicated for that pixel in that frame. If the pixel is off, the decoder will send four zeros over the four refresh cycles. If the pixel is very bright, the decoder will send four ones over the four refresh cycles. If the pixel is of mid-brightness, the decoder will send alternating zeros and ones or a single one and three zeros or three ones and a single zero. Thus, over the four refresh cycles, the pixels will have different refresh rates, thereby providing an apparent brightness variation. However, this decoder is expensive, as it must decode all of the pixels in a frame at the refresh rate, in this example 240 htz. Further, the memory buffers are also expensive, since they must also read and write at the refresh rate.

SUMMARY OF THE INVENTION

The present invention provides an ELD using a memory configuration which decodes and stores all of the refresh commands for a pixel simultaneously.

A decoder receives frames at a frame rate. Each frame includes a brightness code for each pixel, indicating the level of brightness for that pixel for that frame. The decoder decodes each brightness code and generates a plurality of refresh commands based upon each brightness code. Each of the refresh commands for each pixel is stored in a different memory buffer. The number of refresh commands is equal to the number of memory buffers and the number of refresh cycles for each frame. A driver drives the pixels in the display according to each of the memory buffers sequentially at a refresh rate, which is equal to the frame rate times the number of memory buffers.

The decoder need only decode all of the pixels in a frame at the frame rate, rather than the refresh rate. Since the driver is operating at the refresh rate, reading each of the memory buffers in one quarter of the time that it takes the decoder to write an entire frame, the driver may read a memory buffer while it contains refresh commands from the previous frame. However, to the extent a memory buffer is missing information from the current frame when read by the driver, that information will be read by the driver when the decoder is decoding a subsequent frame. For example, when the driver reads the first memory buffer it may contain one quarter of the refresh commands for the current frame and three quarters of the refresh commands for the previous frame.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is a schematic of the display system of the present invention.

DETAILED DESCRIPTION OF A PREFERRED EMBODIMENT

A display system 20 according to the present invention is shown in FIG. 1. An electroluminscent display 22 or ELD 22 generally comprises a matrix of pixels 24 (one shown), as is well known. The ELD 22 sequentially displays a plurality of frames 26 received by the display system 20 at a frame rate, for example, 60 htz, to display a moving video image. Each frame 26 includes a brightness code 28 for each pixel 24 indicating the brightness that each pixel 24 should be displayed for that frame 26. By displaying the pixels 24 at different levels of brightness, a gray scale or gray shade image can be displayed on the ELD 22. The display system 20 of the present invention varies the brightness of the pixels 24 by varying the refresh rates of the pixels 24 selectively according to the brightness codes 28. By refreshing some pixels 24 more frequently, the brightness of the pixels 24 appears to the human eye to be increased. By reducing the number of times a pixel 24 is refreshed, the apparent brightness of the pixel 24 is selectively decreased, according to the brightness codes 28.

Each frame 26 is received by a decoder 30 which decodes each brightness code 28 into a plurality of refresh commands 34 substantially simultaneously. Preferably, the decoder 30 comprises combination logic which decodes each brightness code 28 and generates all of the refresh commands 34 for a pixel 24 simultaneously. In the example illustrated in FIG. 1, each brightness code 28 is decoded into four refresh commands 34. Each of the refresh commands 34 for each brightness code 28 is stored in one of a plurality of memory buffers 36*a–d*. The number of memory buffers 36*a–d* is preferably equal to the number of refresh commands 34. The decoder 30 sequentially decodes the pixels 24 in the frame 26, preferably row by row. As each brightness code 28 is decoded, four refresh commands 34 are stored in the four memory buffers 36*a–d*. The decoder 30 decodes each of the brightness codes 28 in a frame 26 within the time allotted by the frame rate, i.e. before the next frame 26. Therefore, in this example, the memory buffers 36*a–d* are rewritten at a rate of 60 htz generally in parallel.

An ELD driver 40 sequentially reads each of the memory buffers 36*a–d* and drives the ELD 22 according to each of the memory buffers 36*a–d* at a refresh rate. The refresh rate is preferably equal to the frame rate times the number of memory buffers 36*a–d*, in this case 240 htz. The ELD driver 40 includes a column driver 42 and row driver 44 which operate in a known manner to drive ELD 22. The ELD driver 40 drives each of the pixels 24 in the display 22 according to one of the refresh commands 34 in memory buffer 36*a* in a first refresh cycle, memory buffer 36*b* in a second refresh cycle, memory buffer 36*c* in a third refresh cycle and memory buffer 36*d* in a fourth refresh cycle.

In the example shown in FIG. 1, the brightness code 28 for each pixel 24 in a frame 26 is preferably a four bit number from 0000 to 1111 with 0000 indicating that the pixel should be off and 1111 indicating that the pixel should be very bright. The brightness codes 28 are decoded by the decoder 30 according to table 1, shown below:

TABLE 1

| Refresh Cycle | 0000–0010 | 0011–0110 | 0111–1001 | 1010–1100 | 1101–1111 |
|---|---|---|---|---|---|
| 1 | 0 | 1 | 1 | 1 | 1 |
| 2 | 0 | 0 | 0 | 1 | 1 |
| 3 | 0 | 0 | 1 | 0 | 1 |
| 4 | 0 | 0 | 0 | 1 | 1 |
| | OFF | LOW | MED | MED HIGH | HIGH |

As can be seen from Table 1, although the four-bit brightness codes would indicate up to sixteen different levels of brightness, they are converted to five levels of brightness. It should be apparent that other levels of brightness could also be utilized. For example, each brightness code 28 could be decoded into fifteen refresh commands 34 and stored in fifteen memory buffers 36, such that each pixel 24 would receive between zero and fifteen ON refresh commands. The refresh rate would then be fifteen times the frame rate.

In Table 1, brightness codes 000-0010 result in four OFF refresh commands 34 which would each be stored in a different memory buffer 36*a–d*. Brightness code 0011-0110 would generate a single ON refresh command, followed by three OFF refresh commands, producing a low or dim level of brightness in the respective pixel 24. Brightness codes 0111-1001 would be decoded into alternating ON and OFF refresh commands, thereby producing a medium level apparent brightness. Brightness codes 1010-1100 would produce three ON refresh commands and a single OFF refresh command, thereby producing a medium high apparent brightness. Finally, brightness codes 1101-1111 would produce four ON refresh commands, thereby producing a high level of brightness.

In the example shown in FIG. 1, the brightness code 28 in frame 26 is 0100, which is decoded into 1010 (ON-OFF-ON-OFF) refresh commands which are each stored in a memory buffer 36*a–d*, respectively. Therefore, the ELD driver first reads memory buffer 36*a*, which for the illustrated pixel includes an ON refresh command 34. The driver 40 thus drives the corresponding pixel 24 in the ELD 22 during the first refresh cycle.

During the second refresh cycle, the ELD drive 40 reads the second memory buffer 36*b*, which for the illustrated pixel indicates an OFF refresh command 34. Therefore, during the second refresh cycle, the ELD driver 40 switches OFF the corresponding pixel 24.

During the third refresh cycle, the ELD driver 40 reads the third memory buffer 36*c*, which indicates an ON refresh command 34 for the illustrated pixel 24. The ELD driver 40 therefore drives the pixel 24 on during the third refresh cycle.

Finally, during the fourth refresh cycle, the ELD driver 40 reads the fourth memory buffer 36*d* which indicates an OFF refresh command 34 for the illustrated pixel 24. The ELD driver 40 therefore switches OFF the corresponding pixel 24 in the ELD 22. In this manner, the pixel 24 corresponding to the brightness code 28 is illuminated in alternating refresh cycles during the frame 26 and thus has an apparent medium brightness.

It should be noted that the ELD driver 40 is reading the memory buffers 36*a–d* at a multiple (in this example 4) of the frame rate at which the decoder 30 is decoding the brightness codes 28 and writing them into the memory buffers 36*a–d*. As a result, the ELD driver 40 will be reading the first three memory buffers 36*a–c* before the decoder 30 has decoded all of the brightness codes 28 for the frame 26. For example, during the first refresh cycle, the decoder 30 will have decoded only one quarter of the brightness codes 28 for the frame 26 and stored them in memory buffer 36*a*. During the second refresh cycle, the decoder 30 will have only read the first half of the brightness codes 28 and stored them in the memory buffer 36*b*. By the third refresh cycle, the decoder 30 will have read the first three quarters of the brightness codes 28 and stored the appropriate refresh commands 34 in the memory buffers 36*a–d*. However, during the refresh cycles of the subsequent frame 26, those refresh commands 34 missed in the previous frame will be displayed. Any refresh commands 34 not decoded and stored in the memory buffers 36*a–c* in time for the ELD driver 40 to read them and drive the display 22 will be read in the subsequent frame 26. The slight lag will be unnoticeable to the human eye and will appear as a continuous image. Other timing details involved with the memory buffers 36*a–d* will be apparent to those skilled in the art.

The display system 20 of the present invention can utilize a decoder 30 which is less expensive, since it must operate only at the frame rate, rather than at the refresh rate. Further, the memory buffers 36*a–d* need only be able to write at the frame rate, rather than at the refresh rate. It should be noted that the memory buffers 36*a–d* must be able to read at the refresh rate, however. Although specific examples of frequencies, refresh cycles, refresh rates and the number of commands have been given, it should be apparent that the refresh rate is equal to the frame rate times the number of refresh commands (and memory buffers). In order to increase resolution, the number of refresh commands 34 for each brightness code 28 in each frame 26 can be increased to any number, up to the resolution of the brightness codes 28. One skilled in the art could modify the decode table shown in Table 1 accordingly.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A display system comprising:

a display comprising a plurality of pixels;

a plurality of memory buffers;

a decoder receiving frames at a frame rate, each frame including a plurality of brightness codes, each of said brightness codes associated with one of said plurality of pixels, said decoder generating a plurality of refresh commands associated with each said pixel based upon the associated brightness code, where a number of said memory buffers is equal to a number of said refresh commands for each pixel, each of said plurality of refresh commands for each pixel being stored in a different one of said memory buffers, and said decoder generating all said refresh commands for each received frame and storing them in said memory buffers at said frame rate; and a driver sequentially reading said plurality of memory buffers and driving said pixels in said display according to each said memory buffer, wherein said driver reads said refresh commands from each of said buffer memories at a refresh rate equal to said frame rate multiplied by the number of said buffer memories so that said display is driven at said frame rate.

2. The display system of claim 1, wherein said plurality of refresh commands for each said brightness code are generated substantially simultaneously.

3. The display system of claim 1 wherein all of said refresh commands associated with one of said pixels are generated based upon an associated one of said brightness codes before said driver drives said associated pixel based upon any of said refresh commands.

4. The display system of claim 1, wherein said display is an electroluminescent display.

5. The display system of claim 1, wherein said refresh commands comprise ON commands and OFF commands, wherein said driver selectively switches said pixels on and off based on said refresh commands.

6. A display method for driving a display comprising a plurality of pixels based on information stored in a plurality of memory buffers, said method comprising the steps of:

receiving frames at a frame rate, each frame including a plurality of brightness codes, each of said brightness codes associated with one of the plurality of pixels;

decoding the frames by generating a plurality of refresh commands associated with each pixel based upon the associated brightness code, where a number of the memory buffers is equal to a number of said refresh commands for each pixel, each of said plurality of refresh commands for each pixel being stored in a different one of the memory buffers, said decoding step generating all said refresh commands for each received frame and storing them in sthe memory buffers at said frame rate; and driving the display by sequentially reading the plurality of memory buffers and driving the pixels in the display according to each memory buffer, wherein said driving step reads said refresh commands from each of the buffer memories at a refresh rate equal to said frame rate multiplied by the number of the buffer memories so that the display is driven at said frame rate.

7. The display method of claim 6, wherein said plurality of refresh commands for each said brightness code are generated substantially simultaneously.

8. The display method of claim 6, wherein all of said refresh commands associated with one of the pixels are generated based upon an associated one of said brightness codes before said driving step drives the associated pixel based upon any of said refresh commands.

9. The display method of claim 6, wherein the display is an electroluminescent display.

10. The display method of claim 6, wherein said refresh commands comprise ON commands and OFF commands, wherein said driving step selectively switches the pixels on and off based on said refresh commands.

* * * * *